United States Patent [19]

Guido et al.

[11] 4,366,916

[45] Jan. 4, 1983

[54] CONVERTIBLE BAG PACKING CONTAINER AND BAG SUPPORT DEVICE

[75] Inventors: Joseph J. Guido, Hinsdale; Richard Buck, Lombard, both of Ill.

[73] Assignee: Inter Ocean Marketing Corporation, Hinsdale, Ill.

[21] Appl. No.: 285,823

[22] Filed: Jul. 22, 1981

[51] Int. Cl.[3] ..... B65D 90/04; B65B 1/04

[52] U.S. Cl. ..... 220/404; 206/554; 248/97; 248/99

[58] Field of Search ..... 206/554, 45.17, 45.26, 206/284, 288, 622, 626, 634; 220/1 T, 407, 410, 404, 462, 463; 248/95, 97, 99, 100; 312/50; 221/282, 283, 284, 285; 229/54 R

[56] References Cited

U.S. PATENT DOCUMENTS

| | | | |
|---|---|---|---|
| 1,651,020 | 11/1927 | Faas | 220/404 |
| 2,430,155 | 11/1947 | Buttery | 248/95 |
| 2,693,836 | 11/1954 | Hayes | 150/3 |
| 2,725,141 | 11/1955 | Latvala et al. | 206/491 |
| 3,836,037 | 9/1974 | Bass | 220/410 X |
| 4,126,225 | 11/1978 | Hyland et al. | 206/626 X |
| 4,338,979 | 7/1982 | Dow | 220/404 X |

*Primary Examiner*—Steven M. Pollard
*Assistant Examiner*—Bryon P. Gehman
*Attorney, Agent, or Firm*—Lockwood, Dewey, Alex & Cummings

[57] ABSTRACT

A packing container and paperboard blank for storing and transporting bulk quantities of flexible bags is provided that is convertible into an assembled support device for holding the individual bags vertically and in an open condition to permit easy loading of the flexible bags. The device includes perforated portions including those for forming a removable front panel and a pair of upstanding ears that are secured in place.

14 Claims, 9 Drawing Figures

CONVERTIBLE BAG PACKING CONTAINER AND BAG SUPPORT DEVICE

BACKGROUND AND DESCRIPTION OF THE INVENTION

The present invention generally relates to a device for holding and supporting a bag. More particularly, the invention relates to a container and blank therefor for storing and transporting large quantities of bags, especially those made of flexible film, which container converts to a device for holding and supporting one or more such bags in an open and stable condition while goods are placed thereinto.

Bags made of flexible film such as polyethylene, polypropylene or the like, have achieved limited popularity in both home and commerical settings, and have proved especially desirable for packaging food articles in such settings. Supermarkets, groceries and the like have begun using relatively small flexible film bags to supplement paper bagging by what amounts to individually wrapping potentially leaky items such as meat, fruit, dairy and frozen food products. Such bags are not only useful to prevent potential leaks but are also typically more economical than are paper bags. More recently, supermarkets have begun to recognize that these advantages could well be put to more extensive use by using larger flexible film bags to replace the heavy weight large brown paper grocery bags for use at retail checkout counters for customer convenience to carry away a number of differently sized and shaped items in a larger, easily transportable package. These larger flexible film bags typically have holding means such as handles, strings, slits or slots. Especially popular are flexible film bags of the so-called tee-shirt variety described in U.S. Pat. No. 3,180,557.

It would be advantageous to use such flexible film bags as primary packing bags rather than in conjunction with paper bags since such flexible film bags are cheaper than paper bags and use of such flexible film bags would also doubly insure against leaks or possibly eliminate the need for double bagging altogether. However, such bags have one serious drawback to being used as primary packing bags in that they do not have enough stiffness to be self-standing or self-supporting. This drawback necessitates attempting to fill the bag either by laying it horizontally on its side, which is undesirable from a packing viewpoint, or by manually holding the bag vertically while holding it open, which is awkward and inefficient.

One attempted solution to these drawbacks is to provide a mechanical support rack to vertically hold the bag open for filling. Currently available support racks are of permanent construction and offer limited flexibility, being designed to fit a particular bag size and normally requiring that the rack be anchored to the checkout counter or an adjacent shelf. Installing such support racks requires the installer to make a significant commitment both of funds to purchase and install such racks as well as of space to permanently commit counter and/or shelf space for such racks. These drawbacks tend to negate the economical incentive to use such plastic bags in place of the traditional large paper bags.

By the present invention, the packaging container in which the flexible film bags are transported and stored in bulk is designed to be readily converted into a sturdy but impermanent flexible film bag support rack which is free-standing, disposable, portable and inexpensive, as well as of a size that is best suited for the bags that had been stored in bulk in the packaging container from which the bag support rack was converted.

Accordingly, it is a general object of the present invention to provide a support rack for flexible film bags.

It is a further object of the present invention to provide a support rack for flexible film bags which is economical and easy to construct.

It is a further object of the present invention to provide a support rack for flexible film bags which is also a bulk packing container for such flexible film bags.

It is a further object of the present invention to provide a support rack for flexible film bags which is portable, free-standing and disposable.

These and other objects are set forth in the following detailed description of the present invention as shown in the attached drawings of which:

Figure 1:
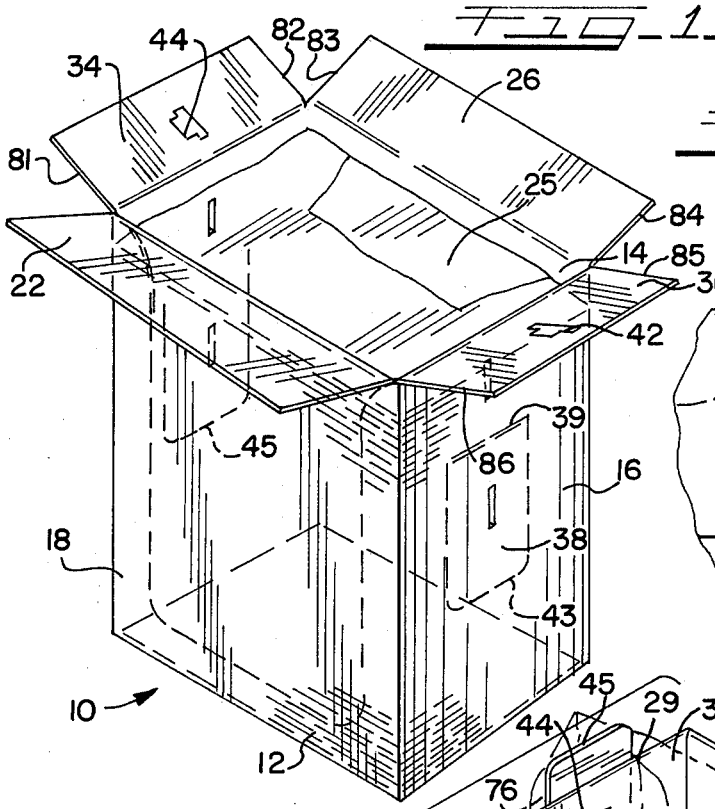
FIG. 1 is a perspective view of the preferred embodiment of the device according to the invention showing a quantity of collapsed bags stored in bulk therewithin.

The present invention is generally embodied in a packing container 10 for flexible film bags, having a front face 12, a back face 14, and side faces 16 and 18 with corresponding flaps 20, 22, 24, 26, 28, 30, 32 and 34 which when folded generally onto themselves form a bottom face 17 and a top face 19 of the container 10. Typically, the container 10 will be constructed of a paperboard such as corrugated board. In accordance with the present invention, the front face 12 and the side faces 16 and 18 have a plurality of perforations which define a removable front panel 36 and upstanding side ears 38 and 40 for holding bags, especially flexible film bags, thereon. These perforations allow the packing container to serve the dual purpose of a bulk shipping container for flexible film bags and a support rack for opened flexible film bags.

Figure 2:
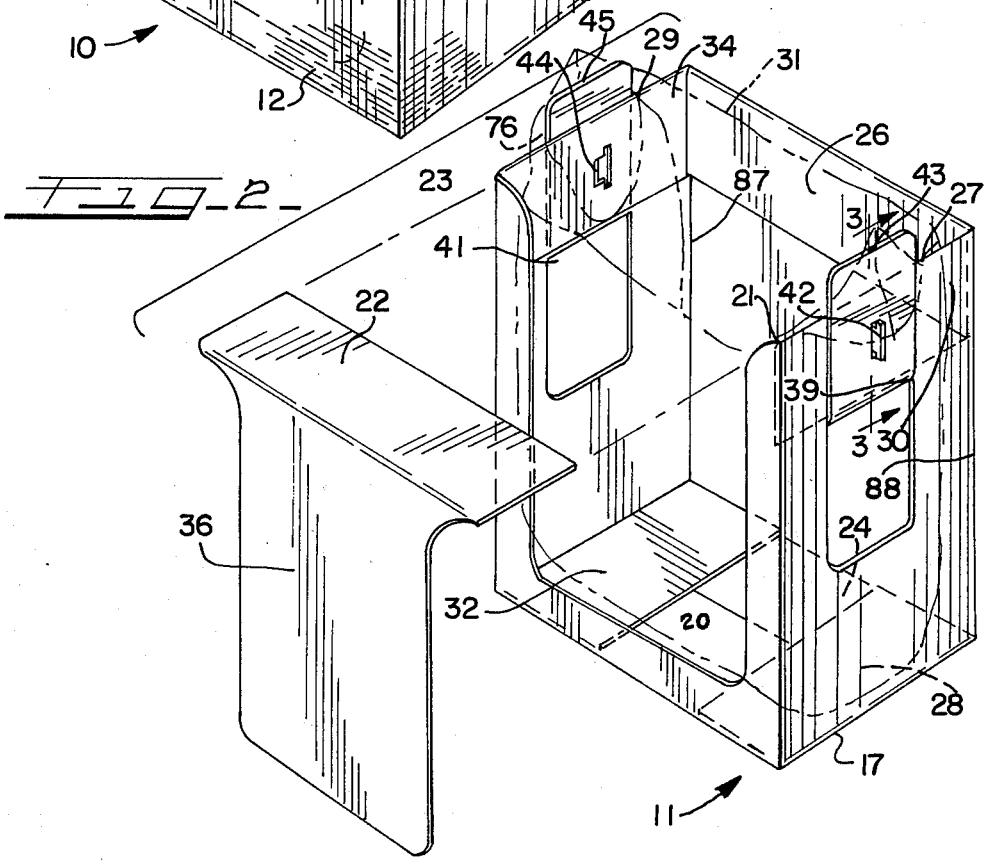
FIG. 2 is an exploded perspective view of the embodiment shown in FIG. 1 when in use with an open bag being supported thereby.

Turning now to a more detailed consideration of the present invention, which is shown in its preferred embodiment for the purpose of illustration and not limitation, FIG. 2 depicts the packing container 11 embodying the present invention in assembled form for holding and supporting flexible film bags in bulk. The faces 12, 16 and 18 are perforated. These perforations of the front face 12 include a generally horizontal perforation 13 and generally vertical perforations **15*a* and 15*b* that extend upwardly between the horizontal perforation 13 and free edge locations of the container 11** to define a removable front panel 36. Preferably, as illustrated, the free edge locations are defined by the common corner 21 of the flaps 22 and 30 and the common corner 23 of flaps 22 and 34, whereby the entire top flap 22 is removed with the removable front panel 36. The vertical perforations 15*a* and 15*b* can, as illustrated, flare outwardly to the common corners 21 and 23 to define a removable front panel 36 that is wider at the top than at the bottom thereof.

The perforations are of such a depth and spacing as to allow the front face 12 to be of sufficient sturdiness so as not to break open during storage and transport yet allow the front panel 36 to be readily removable by either direct pressure to the perforations or preferably by pulling on the flap 22. Removal of the front panel 36 and the flap 22 allows easy access to the bulk supply of folded collapsed bags 25 stored and shipped within the container 10 as well as to the interior of the assembled support device 11. Thus the supply of bags 25 can be unloaded with minimum effort, avoiding tipping the container upside down or awkwardly unloading by forcing ones hands down through the top of the container.

Easy access to the interior of the container is also in accordance with the aspect of the present invention which permits the unloaded packing container 10 to be converted into the assembled support device 11. In accordance with this aspect of the present invention, side faces 16 and 18 each have similar arrangements of perforations defining ears 38 and 40. Ears 38 and 40 are structured and dimensioned such that free ends 43 and 45 thereof project above opposed top edges 27 and 29 of the device 11 when the ears 38 and 40 are folded upwardly at their upper fold lines 39 and 41. This arrangement allows the ears 38 and 40 to function as support posts for a flexible film bag 26 such as a tee-shirt flexible film bag, a slit handle plastic bag, or the like, this structure being especially suitable for the so-called tee-shirt type of bag. The ears 38 and 40 are upwardly folded at their upper fold lines 39 and 41 either inwardly or outwardly with respect to the support device 11, depending upon which one of the several illustrated embodiments of the ear securing means is desired.

The ear securing embodiment shown in FIGS. 1 through 4 folds the ears 38 and 40 outwardly and upwardly at fold lines 39 and 41, to a generally vertical orientation, which allows the upper portions of side faces 16 and 18 to reinforce ears 38 and 40 against any inward and downward force exerted by a supported bag 26. It should be noted that any such force would be minimal due to the fact that in all of the embodiments, the side faces 16 and 18 are of a height such that the base of the supported bag 26 rests on the bottom of the assembled support device 11. The flaps 26, 30 and 34 are folded inwardly and downwardly to a generally vertical orientation whereby their longitudinal edges 81, 82, 83, 84, 85 and 85 butt against each other and/or the longitudinal or height corner portions 87 and 88 of the container 11 in order to increase the strength of the vertical container walls and to help retain the shape of the container 11.

Figure 3:
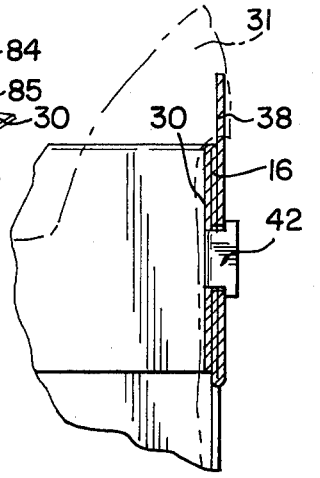
FIG. 3 is a sectional view along the line 3—3 of FIG. 2.
Figure 4:
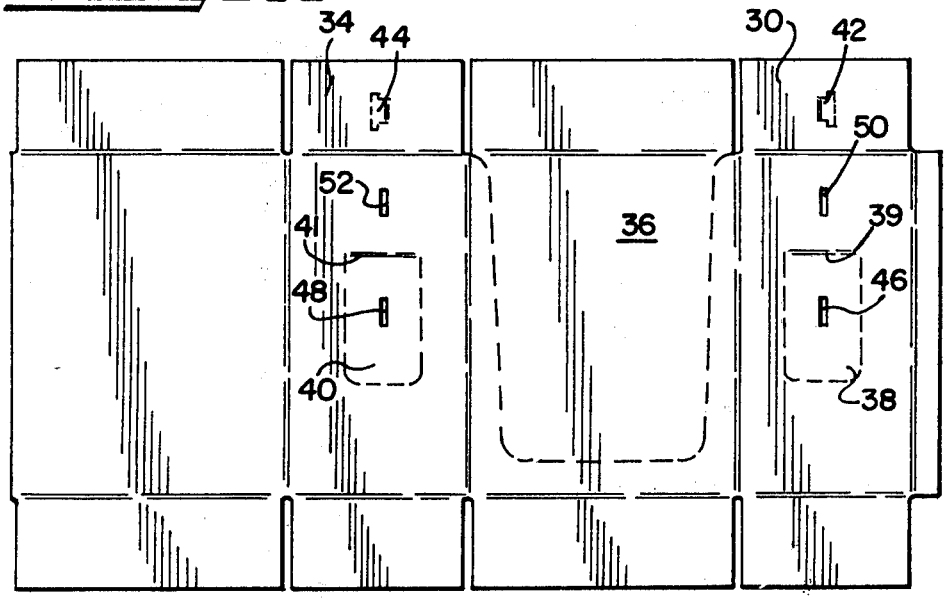
FIG. 4 is a plan view of a paperboard blank for the device of FIG. 1.

With more particular reference to the ear embodiment of FIGS. 1 through 4, the securing means includes flaps 30 and 34 having tabs 42 and 44, which tabs 42 and 44 preferably have projecting portions to retain the tabs 42 and 44 in slots, and they can be T-shaped as shown. This securing means further includes slit shaped perforations 46, 48, 50 and 52 in the side faces 16 and 18 and ears 38 and 40 for receiving the tabs 42 and 44. As best illustrated in FIGS. 3 and 4, the tab 42 and the slits 46 and 50 are structured and positioned so as to be aligned with each other when the flap 30 is folded inwardly and downwardly and the ear 38 is folded outwardly and upwardly. Likewise, the tab 44 and the slits 48 and 52 align with each other when the flap 34 is folded inwardly and downwardly and the ear 40 is folded outwardly and upwardly. Once so aligned, the punched out tabs 42 and 44 interlock with the respective slits 50 and 46, and 52 and 48, to secure the ears 38 and 40 in an upstanding orientation.

Figure 5:
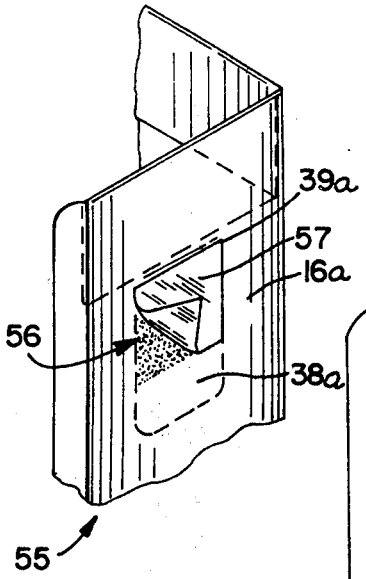
FIG. 5 is a detailed perspective view illustrating an alternative embodiment of the bag support ears of the device.

FIG. 5 illustrates another embodiment of the ear securing means wherein the ears 38*a* (only one shown) have adhesive securing means 56 and readily removable protective strip 57. In this embodiment, the ears 38*a* are secured to the outer surface of the side faces by removing the protective strip 57 to expose a pressure sensitive adhesive area 56 and then folding the ears 38*a* outwardly and upwardly at fold lines 39*a* and applying pressure thereto so as to bond the ear 38*a* to side face 16*a* and the opposing ear to its side face. It should be noted that the adhesive securing means 56 can be used alone or in combination with the other embodiments of the ear securing means.

Figure 7:
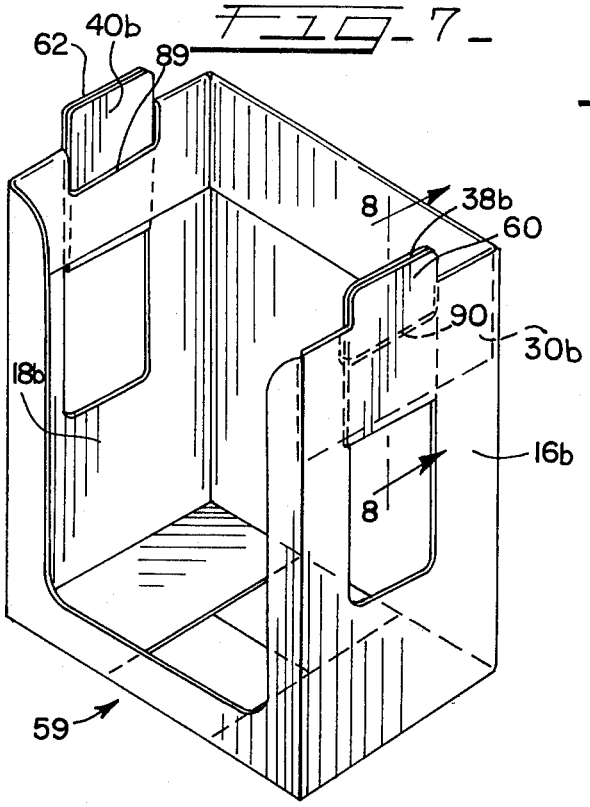
FIG. 7 is a perspective view illustrating a further alternate embodiment of the support ears of the device.
Figure 8:
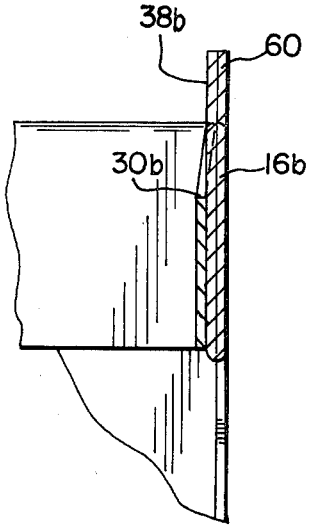
FIG. 8 is a sectional view along the line 8—8 of FIG. 7.
Figure 9:
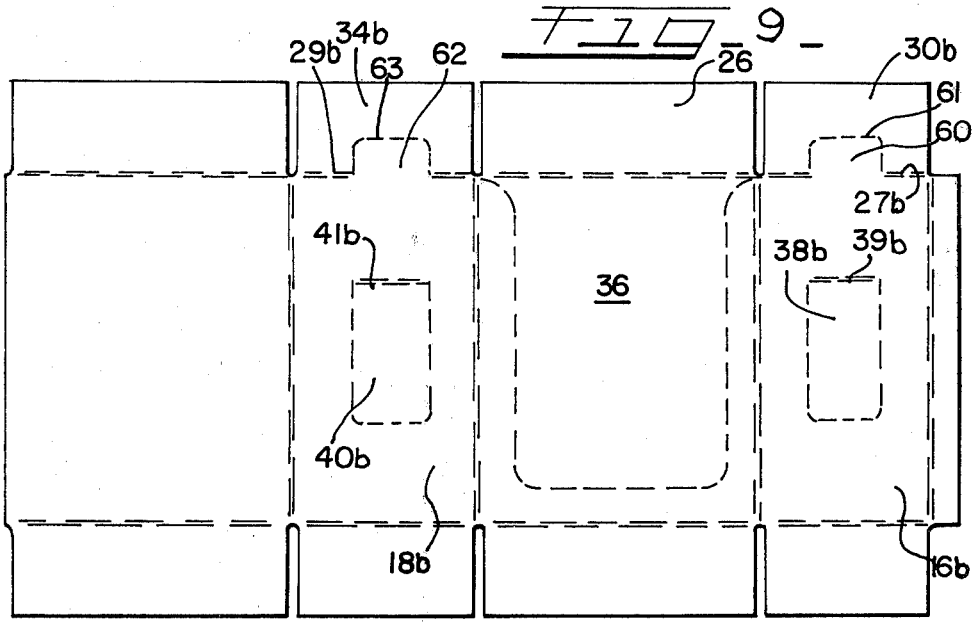
FIG. 9 is a plan view of a paperboard blank for the device of FIG. 7.

FIGS. 7 through 9 show an assembled support device 59 embodying another ear securing means which provides double-walled upstanding support ears. Flaps 30*b* and 34*b* of the assembled support device 59 have perforations defining areas which can be readily punched out to provide upstanding outer ear members 60 and 62 while forming apertures 89 and 90. Inner ear members 38*b* and 40*b* are punched out and folded inwardly and upwardly at horizontal fold lines 39*b* and 41*b* through the apertures 89 and 90, after which the flaps 30*b* and 34*b* are folded inwardly and downwardly while the outer ear members 60 and 62 remain in their upstanding condition so as to form a double-walled upstanding ear comprising inner and outer ear members 38*b* and 60 and a double-walled upstanding ear comprising inner and outer ear members 40*b* and 62.

The strength and stability of the inner ear members 38*b* and 40*b* can be maximized in this embodiment by positioning the perforations defining the inner ear members 38*b* and 40*b* and the outer ear members 60 and 62 such that the vertical length of the inner ear members 38*b* and 40*b* is substantially equal to the distance between the upper fold lines 39*b* and 41*b* and the remote end 61 and 63 of the outer ear members 60 and 62, while the distance between the upper fold lines 39*b* and 41*b* and the fold edges 27*b* and 29*b* of the flaps 30*b* and 34*b*, respectively, is greater than the distance from the edges 27*b* and 29*b* to the remote ends 61 and 63, respectively, which is generally equal to the height of the outer ear members 60 and 62. This relative positioning causes the side faces 16*b* and 18*b*, the flaps 30*b* and 34*b*, and the outer ear members 60 and 62 all to reinforce the inner ear members 38*b* and 40*b* against movement in any direction.

Figure 6:
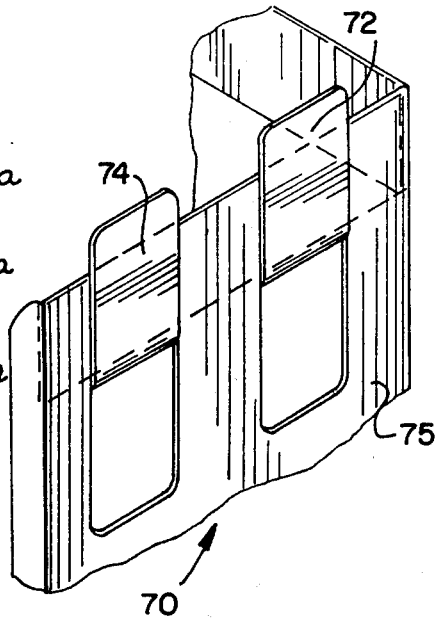
FIG. 6 is a detailed perspective view illustrating another alternate embodiment of the bag support ears of the device.

Any embodiment of the bag securing means could be duplicated in packing containers by providing multiple pairs of ears to support multiple flexible film bags. Such an arrangement is illustrated in FIG. 6 where assembled support device 70 has two pairs of upstanding ears 72 and 74 located along a side panel 75 having a horizontal width adequate to accommodate two bags filled with goods. Additional pairs of ears can be provided as desired.

In use, the container is converted to an assembled support device by punching out the various perforations, by removing the front panel 36, and by assembling the upstanding ears. Then a flexible film bag 26 is hung on the upstanding ears through holding means 76 of the bag to thereby support the bag in a fully opened condition, after which groceries or other items are readily inserted into the opened bag 26. Once filled, the bag 26 is easily lifted out of the assembled support device by grasping the bag holding means 76.

While in the foregoing specification, certain embodiments of this invention have been described in detail, it will be appreciated that modifications and variations therefrom will be apparent to those skilled in this art. Accordingly, this invention is to be limited only by the scope of the appended claims.

What is claimed is:

1. A packing container for bulk quantities of flexible film bags which is convertible into an assembled bag support device, said container comprising:

multiple side faces having perforations defining upstanding ears for supporting flexible film bags;

means for securing said ears in an upstanding orientation;

a front face having perforations defining a removable front panel, said front face being continuous with said multiple side faces;

a back face that is continuous with said multiple side faces;

a bottom face that interconnects said multiple side faces, said front face and said back face at their respective bottom edges; and a top face including multiple flaps that are connected to and that are foldable against said faces.

2. The packing container and support device as claimed in claim 1, wherein one of said multiple flaps is a top flap of the front face, and said perforations defining the removable front panel extend between one common corner of the front face top flap, the front face and one of the side faces and between another common corner of the front face top flap, the front face and another of the side faces, whereby said top flap of the front face is removed with said removable front panel.

3. The packing container and support device as claimed in claim 1, wherein said upstanding ears have free ends that project above said multiple side faces.

4. The packing container and support device as claimed in claim 1, wherein said perforations defining the upstanding ears are spaced apart to form a fold line upon which said upstanding ears are folded upwardly.

5. The packing container and support device as claimed in claim 1, wherein one of said multiple flaps is a top flap of one of the multiple side faces and another of said multiple flaps is a top flap of another of the multiple side faces, each of said side-face top flaps has perforations defining tabs, each of said upstanding ears has perforations defining slits, and said tabs and said slits are in alignment with each other such that the respective slits receive the respective tabs when the respective side-face top flaps are downwardly oriented and the respective ears are upwardly oriented to thereby define said ear securing means.

6. The packing container and support device as claimed in claim 1, wherein one of said multiple flaps is a top flap of one of the multiple side faces and another of said multiple flaps is a top flap of another of the multiple side faces, each of said upstanding ears of the multiple side faces defines one of two ear members of a double-walled upstanding ear, and each of said side-face top flaps has perforations defining the other of said two ear members.

7. The packing container and support device as claimed in claim 1, wherein one of said multiple flaps is a top flap of one of the multiple side faces and another of said multiple flaps is a top flap of another of the multiple side faces, each of said upstanding ears of the multiple side faces defines an inner ear member of a double-walled upstanding ear, and each of said side-face top flaps has perforations defining an outer ear member of said double-walled upstanding ear.

8. The packing container and support device as claimed in claim 6, wherein said one ear member is defined by perforations that are spaced apart to form an ear member fold line, each said side-face top flap has a fold edge between said top flap and said side face, said other ear member has a remote upper end, and the distance between said ear member fold line and said fold edge is greater than the distance between said fold edge and said remote upper end, whereby a portion of said side-face top flap butts against and supports said one ear member when said side face top flap is folded downwardly to a generally vertical orientation.

9. The packing container and support device as claimed in claim 6, wherein said ear securing means includes said side-face top flap in combination with an aperture in said side-face top flap, said aperture being defined by the perforated other ear member, said one ear member projecting through said aperture and said side-face top flap lying over said one ear member.

10. The packing container and support device as claimed in claim 1, wherein said ear securing means includes an adhesive for securing said upstanding ears in place.

11. The packing container and support device as claimed in claim 1, wherein said upstanding ears include multiple pairs of opposed ears, whereby multiple bags are simultaneously supported by said device.

12. The packing container and support device as claimed in claim 1, wherein said multiple flaps are folded downwardly to a generally vertical orientation whereby longitudinal edges of said flaps butt against each other or against a longitudinal corner portion common to said back face and one of said multiple side faces.

13. A blank for a container to pack bulk quantities of flexible film bags which is convertible into an assembled bag support device, said blank comprising:

multiple side faces having perforations defining ears for supporting bags on the assembled bag support device;

means for securing said ears in an upstanding orientation on the assembled bag support device;

a front face having perforations defining a removable front panel, said front face being continuous with at least one of said multiple side faces;

a back face that is continuous with at least one of said multiple side faces;

a bottom face composed of panels extending from one or more of said multiple side faces, said front face and said back face, said bottom face panels interconnecting said multiple side faces, said front face and said back face at their respective bottom edges on the container and on the assembled bag support device; and a top face including multiple flaps that are extensions of and are foldable against said faces.

14. In combination, a flexible bag with handle means, together with a packing container for bulk quantities of the flexible bags which container is convertible into an assembled bag support device, the combination comprising:

a flexible bag having handle means near the top of an open end thereof; and a container including multiple side faces having perforations defining upstanding ears for receiving said handle means of the flexible bag; a front face having perforations defining a removable front panel of a size to permit passage of said flexible bag when filled with goods; a back face that is between and connected to said multiple side faces; a bottom face between said multiple side faces, said front face and said bottom face, said bottom face being of a size to accommodate one of said flexible bags when fully opened, said bottom face being spaced from said upstanding ears by a distance generally equal to the vertical length of said flexible bag; and a top face having multiple flaps that are connected to and that are foldable against said faces.

* * * * *